US007992232B1

(12) United States Patent
Stone

(10) Patent No.: US 7,992,232 B1
(45) Date of Patent: Aug. 9, 2011

(54) TOILET FLUSH CONTROL DEVICE

(76) Inventor: Paul A. Stone, Silver Spring, MD (US)

( * ) Notice: Subject to any disclaimer, the term of this patent is extended or adjusted under 35 U.S.C. 154(b) by 0 days.

(21) Appl. No.: 12/587,839

(22) Filed: Oct. 14, 2009

(51) Int. Cl.
*E03D 5/00* (2006.01)

(52) U.S. Cl. ..... 4/405; 4/324; 4/325; 4/403; 4/395

(58) Field of Classification Search ..... 4/325, 381, 4/405

See application file for complete search history.

(56) References Cited

U.S. PATENT DOCUMENTS

| | | | | |
|---|---|---|---|---|
| 1,335,763 | A | 4/1920 | Stoltz | |
| 1,556,301 | A | 10/1925 | O'Neil | |
| 1,932,224 | A | 10/1933 | Mitchell | |
| 2,835,900 | A * | 5/1958 | Gleason | 4/324 |
| 3,877,082 | A * | 4/1975 | Wilhelm | 4/326 |
| 4,080,668 | A * | 3/1978 | Banes | 4/325 |
| 5,440,765 | A | 8/1995 | Weir | |
| 5,819,330 | A | 10/1998 | Yokel | |
| 7,464,415 | B2 | 12/2008 | Randolph | |

* cited by examiner

*Primary Examiner* — Gregory L Huson
*Assistant Examiner* — Lauren Heitzer
(74) *Attorney, Agent, or Firm* — David L. Banner

(57) ABSTRACT

A device for controlling valve travel of the flush valve of a toilet operated by a rigid linkage rod and for forcibly returning the valve to the closed position. The device may comprise a spring contained within a sleeve. The sleeve has end caps bearing openings for passing the rigid linkage rod entirely through the sleeve and spring. One end cap may be threaded to enable it to compress and immobilize the spring for selectively defeating operation.

8 Claims, 4 Drawing Sheets

TOILET FLUSH CONTROL DEVICE

FIELD OF THE INVENTION

The present invention pertains to apparatus for controlling flushing of a toilet, and more particularly to a device that selectively limits the degree of opening of a water valve such that the amount of water dispensed in a single flush is limited.

BACKGROUND OF THE INVENTION

Over the years, water conservation requirements have been imposed on residential toilets. Formerly, when no water usage limits were imposed, toilets were built with tanks containing about five gallons. A single flushing apparatus dispensed most of this water. Later, the amount of water stored and dispensed was reduced to about 1.6 gallons per flush.

In conventional toilets the water for flushing is held in a tank mounted higher than the toilet bowl and flows from the tank into the bowl when the user opens a valve between the two by depressing a control lever. In some such toilets (usually called flapper toilets) the linkage from the lever to the valve, and the valve itself, are designed so that the valve drops partly or entirely back into its seat, reducing or stopping the flushing, as the user partly or entirely releases the control lever. However, in most conventional toilets, the linkage from the control lever to the valve, and the valve itself, are designed so that as soon as the user depresses the control lever by more than a very minimal amount the valve floats completely off of its seat and the flow of water from the tank into the bowl cannot be reduced or stopped by the user but water flow stops only when the water level in the tank falls almost to the empty level, thereby allowing the valve to sink back to its seat. The present invention pertains to the latter type of toilet.

Conserving water in a conventional toilet has been attempted using expedients such as placing bricks in the tank to reduce tank capacity, and bending float rods to lower the water level in the tank. However, none of these prior art efforts have proven entirely satisfactory.

Another factor in water conservation is the effectiveness of the flush valve action. Valves may fail to seat properly, thereby continuously leaking tank water into the toilet between flushes. This can account for considerable waste of water over the course of a year.

Another attempt at water conservation is using a dual flush lever arrangement, one for relatively great volume flushes and the other for small volume flushes to control the amount of water used.

It would therefore be desirable to have an apparatus that adjustably limits the amount of water used in a conventional toilet by giving the user control over the volume and flow rate of water being released for each flush, and promoting effective seating of the valve following the flush.

Although water conservation achievable by the toilet user's having control of the rate and amount of flushing is of prime importance, it is desirable in some circumstances to have the toilet flushing operate without the user's exercising such control. This may be the case if, for example, the toilet is to be used by a young child, an infirm person, a house guest, or a visitor to a public establishment. It would therefore be desirable to be able to reversibly convert the toilet easily and without expense between the mode in which the user controls the rate and amount of water flow and the mode in which he or she does not.

DISCUSSION OF THE RELATED ART

U.S. Pat. No. 1,335,763 for CLOSET FLUSH VALVE, issued Apr. 6, 1920 to E. G. Stoltz teaches a spring that exerts downward-directed sealing pressure on a valve.

U.S. Pat. No. 1,556,301 for WATER CONTROLLING MECHANISM FOR FLUSH TANKS, issued Oct. 6, 1925 to Daniel A. O'Neill teaches a spring that holds a rod/valve member in a closed position.

U.S. Pat. No. 1,932,224 for FLUSH VALVE FOR BOWLS, issued Oct. 24, 1933 to J. A. Mitchell shows a spring that urges a plunger downward against a disk.

U.S. Pat. No. 5,440,765 for REVISED AUTOMATIC WATER SHUT OFF FOR STUCK OPEN FLUSH VALVES IN TOILET WATER TANKS, issued Aug. 15, 1995 to Richard L. Weir provides an automatic shut off mechanism for stuck open flush valve. A coil spring, a ball float, and a spring release mechanism separate two cylinders, one within the other.

U.S. Pat. No. 5,819,330 for TOILET ENHANCEMENT, issued Oct. 13, 1998 to Don Yokel teaches a flush handle having push button setting for light and heavy flushes.

U.S. Pat. No. 7,464,415 for AUTOMATIC CUT-OFF VALVE, issued Dec. 16, 2008 to Ovie L. Randolph teaches a supplemental fill valve for use in a toilet tank.

None of the patents, taken singly or in any combination, are seen to teach or suggest the novel toilet flush control device of the present invention.

SUMMARY OF THE INVENTION

In accordance with the present invention a toilet flush control device is provided that limits valve opening and promotes effective closure of the valve. The device limits both the distance and time duration of opening of the valve, so that the amount of water dispensed can be limited. The toilet flush control device also forcibly and effectively returns the valve to its seated or closed position after each flush, thereby assuring effective closure of the valve. The toilet flush control device includes an override feature thereby being readily convertible between a conventional mode of operation and a water-limiting mode of operation.

It is, therefore, an object of the invention to provide a novel toilet flush control device, for use in toilet tanks utilizing a rigid rod to connect the flushing handle to the flush valve, the rigid rod typically being held in place by a guide.

It is another object of the invention to provide a flush control device that utilizes a compressible spring disposed between the flush valve and the guide.

It is yet another object of the invention to provide a flush control device wherein release of the control lever frees the spring to expand, thereby propelling the flush valve back into a seated or closed position.

It is also an object of the invention to provide a flush control device wherein the user can open the flush valve fully or, optionally, open the flush valve partially by operating and holding the control lever less than fully.

It is a further object of the invention to provide a flush control device wherein when the toilet is flushed, the rising valve compresses the spring thereby limiting upward movement of the flush valve.

It is a still further object of the invention to provide a flush control device that provides a user controllable flushing duration wherein release of the flushing lever immediately closes the flush valve.

It is yet another object of the invention to provide a flush control device that may readily be overridden by hand (i.e., by manual detachment of enclosing portions of the flush control device from one another) to allow conventional operation of a toilet into which the flush control device is installed.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

The present invention provides a toilet flush control device for controlling water discharge from a toilet water tank during a flushing operation and also ensuring tight closure of a flush valve upon release of the toilet's flush handle.

Figure 1:
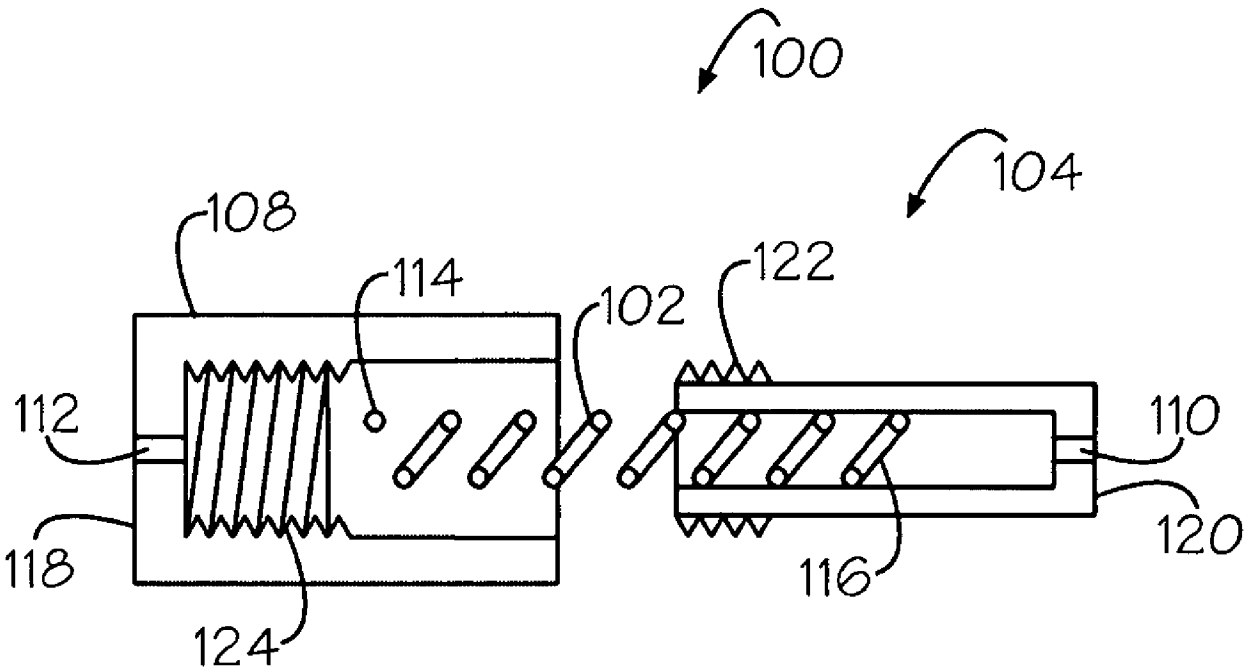
FIG. 1 is a side cross sectional view of a toilet flush control device in accordance with the invention.

Referring first to FIG. 1, there is shown a novel toilet flush control device 100 for limiting duration and travel of the flush valve of a toilet, in toilets having a rigid linkage rod leading to and connected to the flush valve.

The toilet flush control device 100 has a compressible coil spring 102 having a proximal end 114 and a distal end 116. Coil spring 102 is contained (i.e., enclosed) within a housing 104 that comprises a hollow cylinder. The housing 104 comprises a sleeve 106 and an end cap 108. The sleeve 106 and the end cap 108 each have respective openings 110, 112, not shown, for passing the rigid linkage rod entirely through the toilet flush control device 100. The openings 110, 112 are large enough to accommodate the diameter of the linkage rod, and will typically be between approximately one sixteenth and three eights of an inch in diameter.

End walls 118, 120 serve to retain the coil spring 102 within the housing 104 when the sleeve 106 is connected to the end cap 108. The sleeve 106 and the end cap 108 may have respective mutually mateable screw threading 122, 124 so that the end cap 108 may be removably coupled to the sleeve 106 when it is desired to maintain the coil spring 102 in a compressed configuration.

In an uncompressed or free state, coil spring 102 limits travel of the flush valve 142 (FIG. 4) of the toilet.

In a compressed configuration, the toilet flush control device 100 is inhibited or overridden. Flush valve 142 may then travel freely.

Of course, fastening arrangements for holding the sleeve in the housing are not limited to threading. Rather the inventive concept and enhancement may be applied using various methods for connecting and disconnecting a sleeve within a housing. Such methods are believed to be well known to those of skill in the art and are not further described herein.

Figure 2:
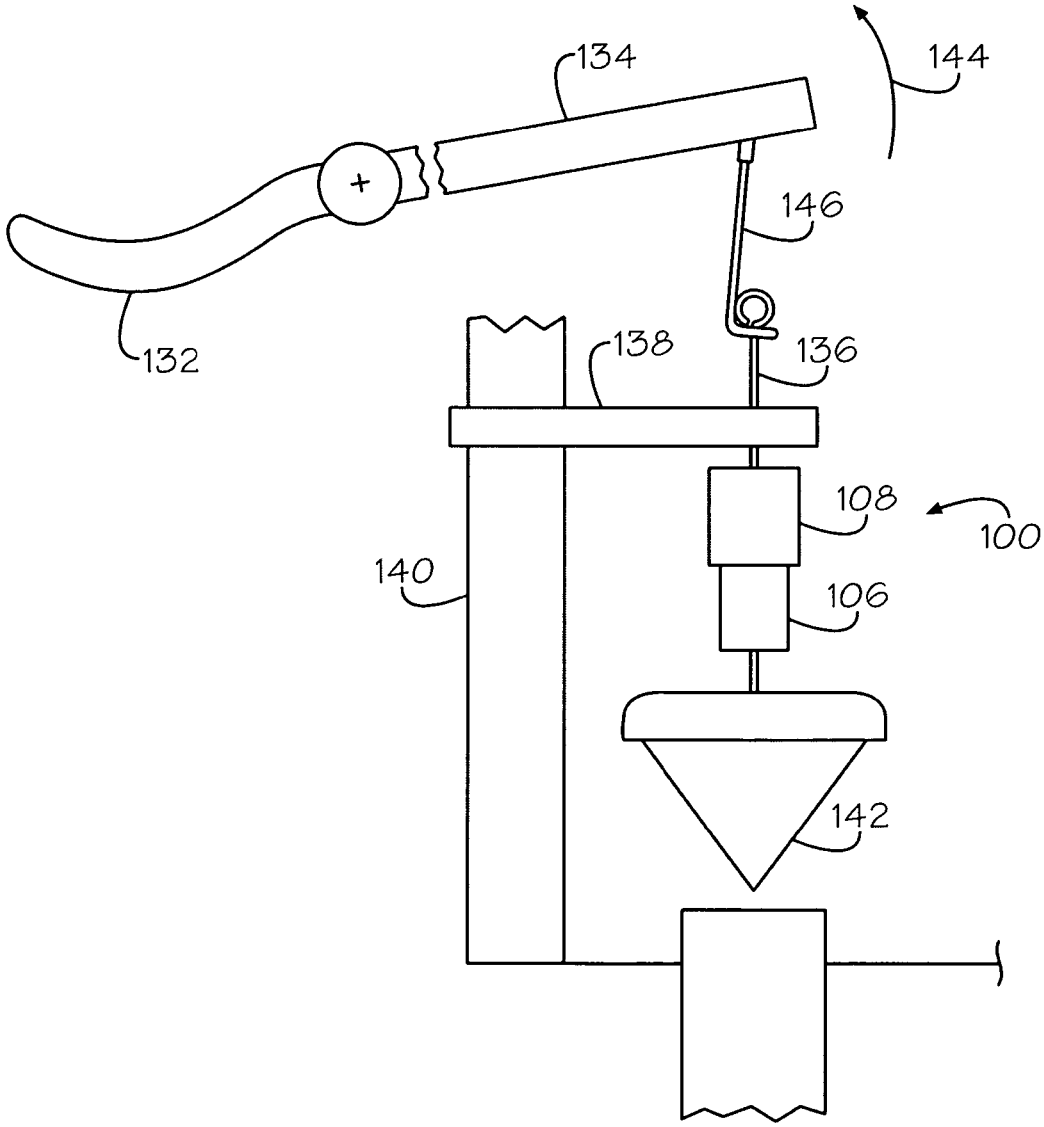
FIG. 2 is a front, elevational view of a flushing mechanism for a toilet with the toilet flush control device of FIG. 1 incorporated therein.

Referring now also to FIG. 2, there is shown a portion of a flushing mechanism contained within the water storage tank 140 of a toilet, tank 140 not shown in its entirety, for operating a flush valve 142. The linkage includes a manual operator such as a control lever 132 which is accessible from outside the toilet, an arm 134, and a lift rod that, when raised by arm 134, lifts a rigid rod 136 that leads to and is connected to the flush valve 142. The rigid rod 136 is held in vertical orientation by a guide arm 138.

In FIG. 2, toilet flush control device 100 is shown with the end cap 108 threaded to the sleeve 106. The rigid rod 136 has been passed entirely through the toilet flush control device 100. The housing 104 is selectively disposed to hold the toilet flush control device 100 in a compressed state exerting no significant influence on valve operation, so that the toilet operates in conventional fashion.

Figure 3:
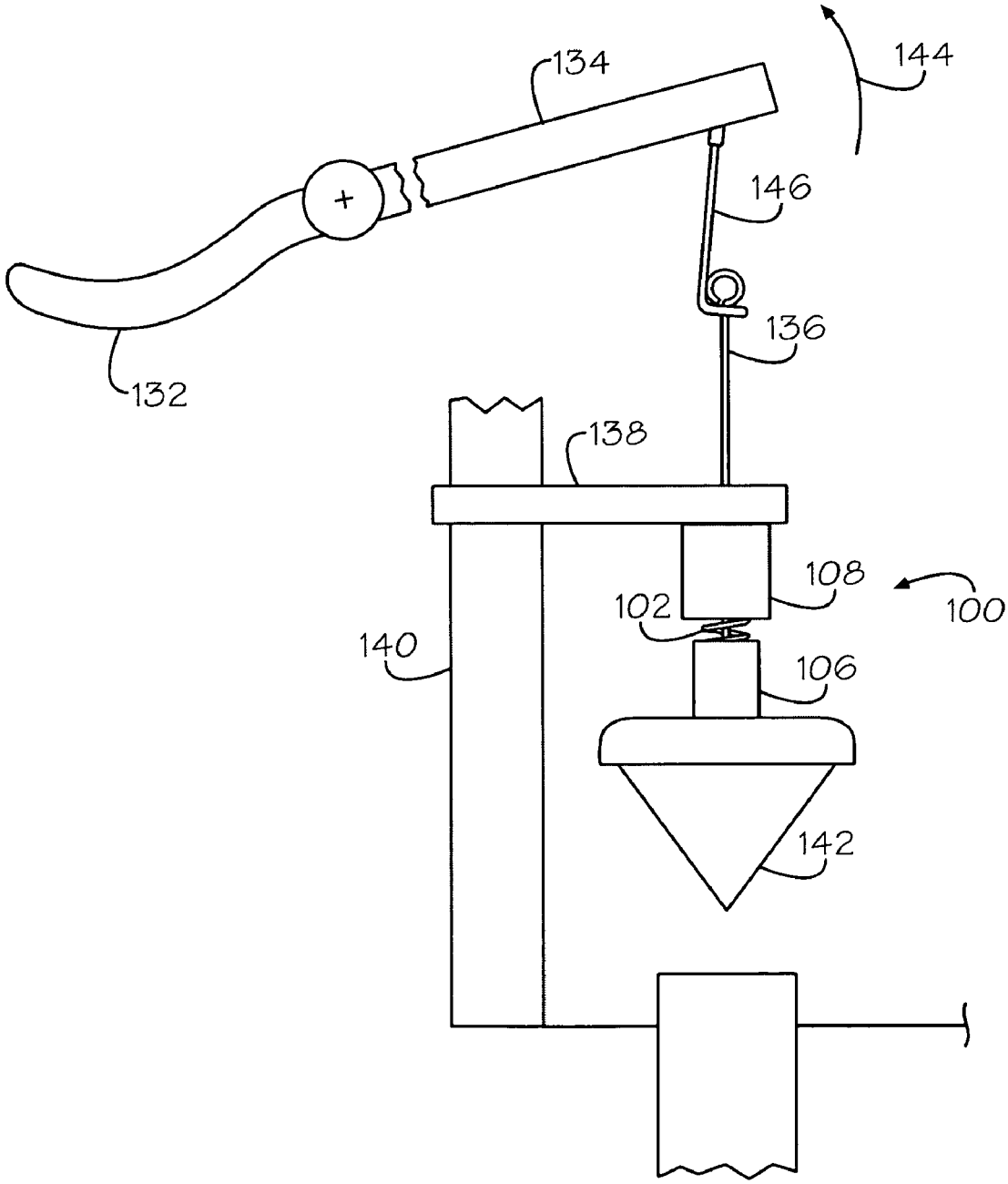
FIG. 3 is a front elevational view of the flushing mechanism for a toilet of FIG. 2 with the toilet flush control device in an operative, compressed position, and with the toilet flush valve open.

Referring now also to FIG. 3, there is shown the toilet flush control device 100 in its operative condition, with the control lever 132 shown in the flushing position. The purpose of the toilet flush control device 100 when in its operative condition is to limit valve travel when the valve 142 is opening to release water from the water storage tank during a flushing event and to return the flush valve 142 forcibly back to the closed position depicted in FIG. 4. In the operative condition, the end cap 108 is uncoupled from the sleeve 106. End wall 118 of end cap 108 is forced upward against a lower surface, not specifically identified, of guide arm 138 by coil spring 102. End wall 120 of sleeve 106 is concurrently forced against an upper surface, not specifically identified, of flush valve 142. Coil spring 102 is still somewhat compressed, although not as much as seen in FIG. 2. The coil spring 102 exerts a downward pressure, as seen in FIG. 3, on the sleeve 106. A similar force is exerted on flush valve 142.

Figure 4:
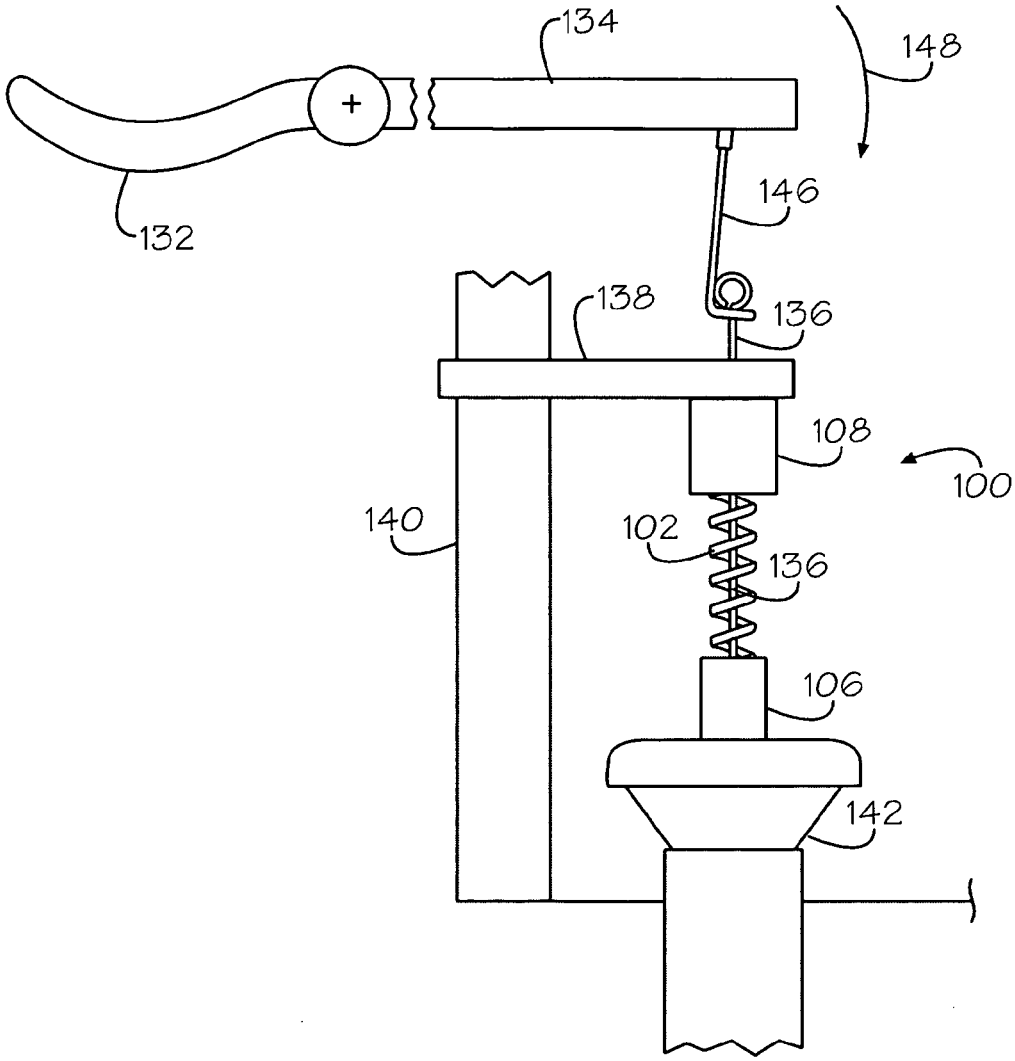
FIG. 4 is a front, elevational view of the flushing mechanism for a toilet of FIG. 2 with the toilet flush control device in an operative, expanded position with the toilet flush valve closed.

Referring now also to FIG. 4, there is shown the position of the flush mechanism after the user releases the control lever 132 at the conclusion of the flush operation. Control lever 132 and the arm 134 pivot clockwise, as seen in FIG. 4 and as indicated by the arrow 148. Coil spring 102 continues to exert an upward force on end cap 108 and a downward force on the sleeve 106. End cap 108 is constrained from moving upwardly responsive to the force of the coil spring 102. However, flush valve 142 is forced downwardly by spring force into the drain conduit, not specifically identified, where it is securely seated. The drain conduit leads to the bowl of the toilet, not shown, so as to discharge released water into the bowl to flush any contents therefrom.

It will be recognized that it is possible to form a housing such as the housing 104 in three pieces or sections such as to include a central sleeve and an end cap at each end of the sleeve (this construction is not illustrated) in place of the two-piece construction described herein. It would also be possible to provide the housing in somewhat open form, such as that of a cage.

It is also possible to provide the function satisfied by the coil spring 102 by using another form of spring device. Also, the spring device may be located outside the housing, disposed in a manner that does not interfere with manual detachment and/or reattachment of sleeve portion 106 and end cap portion 108 of housing 104.

While the present toilet flush control device has been described in connection with what is considered the most practical and preferred embodiments, it is to be understood that the present invention is not to be limited to the disclosed arrangements, but is intended to cover various arrangements which are included within the spirit and scope of the broadest possible interpretation of the appended claims so as to encompass all modifications and equivalent arrangements that are possible.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A flush control device for use with a single handle toilet flush mechanism incorporating a rigid linkage between said single flush handle and a single flush control valve, comprising:

a) a hollow cylinder having a first portion closed at a distal end by a first end wall, and a second portion also closed at a distal end by a second end wall, said first portion and said second portion being selectively connectable to one another at the respective proximal ends thereof and movable between a connected configuration wherein a spring element disposed within said hollow cylinder is compressed defining a disabled configuration and a disconnected configuration wherein said spring element disposed within said hollow cylinder is uncompressed defining an operable configuration;

b) a first opening centrally disposed in said first end wall, and a second opening centrally disposed in said second end wall, said first opening and said second opening having a diameter sized to slidably accommodate a rod forming a portion of said rigid linkage;

c) said hollow cylinder and said spring element being disposed coaxially around said rod forming a portion of said rigid linkage and disposed completely within a supply reservoir of a toilet to which said flush control mechanism is incorporated.

2. The flush control device for use with a toilet flush mechanism as recited in claim 1, wherein said first portion and second portion have threads disposed proximate respective ones of said distal ends, said thread being operable to connect and retain said first portion to said second portion.

3. The flush control device for use with a toilet flush mechanism as recited in claim 1, wherein said spring element comprises a coil spring.

4. The flush control device for use with a toilet flush mechanism as recited in claim 1, wherein both said first opening and said second opening have a diameter in the range between approximately one sixteenth and to three eighths of an inch.

5. In a toilet comprising:

a bowl; a water storage tank; a single flush valve moveable between a first, open position wherein water stored within said water storage tank is released to said bowl, and a second, closed position wherein water stored in said storage tank is retained therein; a single flush handle; a linkage disposed between said single flush handle and said single flush valve, comprising a rigid rod leading to and connected to said flush valve; and a guide fixed to said water storage tank and disposed to constrain said rigid rod allowing only linear movement when said flush valve is moved between said first position and said second position and between said second position and said first position; the improvement comprising:

a toilet flush control device disposed to limit travel of said flush valve when said flush valve is moved between said second, closed position and said first, open position responsive town activating input externally applied to said flush handle, said toilet flush device further disposed to return said flush valve to said second, closed position in response to removal of said externally applied activating input from said flush handle said flush control device comprising:

a) a hollow cylinder disposed in a tank of a toilet and having a first portion closed at a distal end by a first end wall, and a second portion also closed at a distal end by a second end wall, said first portion and said second portion being selectively connectable to one another at the respective proximal ends thereof and movable between a connected configuration wherein a spring element disposed within said hollow cylinder is compressed defining a disabled configuration and a disconnected configuration wherein said spring element disposed within said hollow cylinder is uncompressed defining an operable configuration;

b) a first opening centrally disposed in said first end wall, and a second opening centrally disposed in said second end wall, said first opening and said second opening having a diameter sized to slidably accommodate a rod forming a portion of said rigid linkage.

6. The flush control device for use with a toilet flush mechanism as recited in claim 5, wherein said spring element comprises a coil spring.

7. The flush control device for use with a toilet flush mechanism as recited in claim 5, wherein said first portion and second portion have threads disposed proximate respective ones of said distal ends, said thread being operable to connect and retain said first portion to said second portion.

8. The flush control device for use with a toilet flush mechanism as recited in claim 5, wherein both said first opening and said second opening have a diameter in the range between approximately one sixteenth and three eighths of an inch.

* * * * *